US005285429A

United States Patent [19]

Shockley et al.

[11] Patent Number: 5,285,429

[45] Date of Patent: Feb. 8, 1994

[54] SOUND-PRODUCING ATTACHMENT FOR A CLOCK PENDULUM

[76] Inventors: Lloyd S. Shockley, 840 Apperson Dr., Salem, Va. 24153; Norman S. Shockley, 1218 Grumman Dr., Richmond, Va. 23229

[21] Appl. No.: 116,576

[22] Filed: Sep. 7, 1993

[51] Int. Cl.[5] ..... G04B 17/02; G09F 19/00

[52] U.S. Cl. ..... 368/179; 368/223; 40/485

[58] Field of Search ..... 368/134, 165, 179; 40/426, 485

[56] References Cited

U.S. PATENT DOCUMENTS 4,422,539 12/1983 Denton ..... 185/29

4,544,282 10/1985 Giraldez ..... 368/179

*Primary Examiner*—Vit W. Miska

*Attorney, Agent, or Firm*—Norman B. Rainer

[57] ABSTRACT

A noise producing device that produces a tick-tock sound is provided for use on simulated pendulum clocks that otherwise produce no sound. The device is constructed of an elongated cage member having two extremities provided with hard abutment closures. The cage member is orthogonally associated with the pendulum. A metal ball is confined within the cage, and is adapted to roll back and forth with each swing of the pendulum mechanism. The impact of the ball with each closure produces the desired sound.

7 Claims, 1 Drawing Sheet

SOUND-PRODUCING ATTACHMENT FOR A CLOCK PENDULUM

BACKGROUND OF THE INVENTION

1. Field of the Invention

This invention relates to clocks, and more particularly concerns a device adapted to attach to the pendulum of an otherwise noiseless clock to produce an audible tick-tock sound.

2. Description of the Prior Art

In pendulum clocks of old manufacture, the general function of the pendulum is to oscillate along an arcuate path so that the escapement mechanism of the clock work is actuated periodically to allow a gear mechanism driving the hands of the clock to advance stepwise in controlled incremental fashion under the impetus of a driving force supplied by gravity-activated weights or a wound spring. The motion of the pendulum may be further described as a reciprocating movement along a circular arc between apogees equidistantly opposite a vertical line centered upon the pendulum. In some pendulum clocks, the pendulum is pendant from a support or counterweight member that swings with the pendulum as a component of the overall pendulum mechanism. Pendulum clocks produce an audible tick-tock sound considered by many people to provide a pleasingly restful ambiance.

Many clocks of modern manufacture are based upon electronic principles of operation, and may not produce any sound. In the conventional simulated pendulum clock, an electromagnetic device is employed to drive a pendulum, the electromagnetic device being functionally separated from the timepiece movement.

It is accordingly an object of the present invention to impart a tick-tock sound in synchronization with the pendulum of a simulated pendulum clock.

It is another object of this invention to provide a sound producing device that can be easily attached to a clock pendulum mechanism.

It is a further object of the present invention to provide a device of the aforesaid nature that is durable and amenable to low cost manufacture.

It is a still further object of this invention to provide a simulated pendulum clock equipped with a sound producing device of the aforesaid nature.

These and other beneficial objects and advantages will be apparent from the following description.

SUMMARY OF THE INVENTION

The above and other beneficial objects and advantages are accomplished in accordance with the present invention by a sound producing device for use with a clock having a simulated pendulum, said device comprising:

a) elongated attachment means for securement to said pendulum, and having an exterior surface directed away from said pendulum, b) a cage member elongated upon a center axis between opposed end extremities, and attached to said exterior surface at the midpoint between said extremities and in a manner disposing said axis orthogonally to the direction of elongation of said attachment means, c) hard abutment closures disposed at each extremity of said cage, and d) a ball held within said cage and adapted to roll into contact with each abutment closure at the apogee of each swing of said pendulum.

In a specialized embodiment, the ball makes tight-fitting engagement within said cage, and at least one aperture communicates between the interior of the cage and ambient air.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
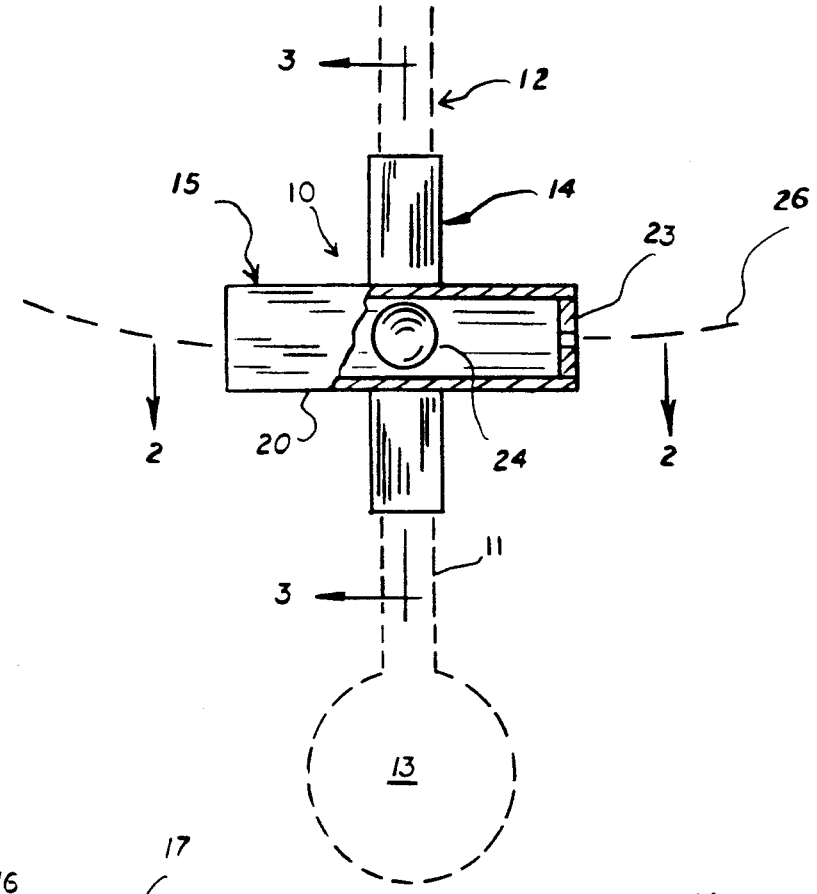
FIG. 1 is a front view of an embodiment of the device of the present invention shown in mounted relationship upon a pendulum, and with portions broken away to reveal interior details.
Figure 2:
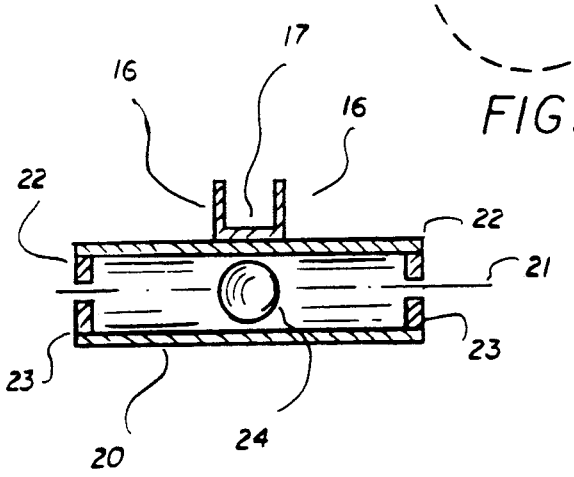
FIG. 2 is a sectional view taken in the direction of the arrows upon line 2—2 of FIG. 1.
Figure 3:
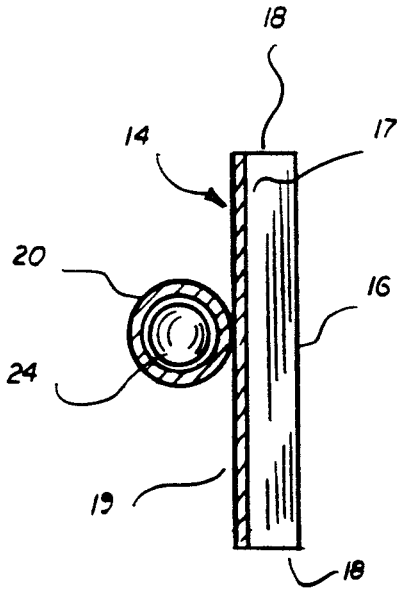
FIG. 3 is a sectional view taken in the direction of the arrows upon line 3—3 of FIG. 1.

Referring to FIGS. 1-3, an embodiment of the sound producing device 10 of the present invention is shown attached to the vertical shaft 11 of simulated pendulum 12 which terminates at its lowermost extremity with a symbolically decorative enlargement 13.

The device is generally comprised of elongated attachment means 14 and cage member 15 that confines a ball bearing 24. The exemplified embodiment of attachment means 14 is contoured as a U-shaped extruded form having opposed embracing shoulders 16 emergent from flat base panel 17. Attachment means 14 is elongated between extremities 18 and is further provided with flat exterior surface 19 directed away from shoulders 16 and pendulum 12. The attachment means is adapted to be secured to pendulum 12 by adhesive, tape or other means.

The exemplified embodiment of cage member 15 is comprised of cylindrical sidewall 20 elongated upon center axis 21 between opposed end extremities 22 which may be spaced apart between about ½ and 2 inches. Sidewall 20 is attached as by soldering or adhesives to exterior surface 19 of said attachment means at the midpoint between extremities 22 and in a manner disposing axis 21 orthogonally to the direction of elongation of pendulum 12. Sidewall 20 may be fabricated of plastic or metal. In alternative embodiments, the attachment means and sidewall 20 may be portions of a monolithic plastic molded structure.

Abutment closure panels 23 fabricated of a hard material such as metal seal each extremity of said cage member. In the exemplified embodiment, apertures 24 are centered within each closure panel 23 in communication between the interior of the cage member and the adjacent ambient air. The function of the apertures is to enhance the transmission of sound away from said cage member.

A smooth surfaced metal ball 24, typically a ball bearing, is confined within cage member 15 and adapted to roll therein back and forth between closure panels 23. In such manner, the ball rolls into contact with alternating closure panels 23 at each apogee position of the pendulum. The weight of the ball and the length of the cage member are carefully selected so that the impact of the ball with the closure panel produces a sound of acceptable volume and tonal characteristics. The device may be attached to the front or rear of the pendulum at any elevation thereupon whereby the device moves on the radius of curvature 26. However, the device is preferably positioned upon the upper third of the length of the pendulum. This causes the motion of the device to proceed along a path having a relatively small radius of curvature. This, in turn, produces a faster movement of the ball with attendant greater kinetic energy for creating a louder noise upon impact with said closure panels. A preferred radius of curvature for the path of movement of the device is in the range of 1 to 6 inches. When positioned in such manner, axis 21 of the device travels as a tangent line in a locus or path which is an arc of a circle having the aforesaid radius.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A sound producing device for use with a clock having a simulated pendulum, said device comprising:

a) elongated attachment means for securement to said pendulum, and having an exterior surface directed away from said pendulum, b) a cage member elongated upon a center axis between opposed end extremities, and attached to said exterior surface at the midpoint between said extremities and in a manner disposing said axis orthogonally to the direction of elongation of said attachment means, c) hard abutment closures disposed at each extremity of said cage member, and d) a ball held within said cage and adapted to roll into contact with each abutment closure at the apogee of each swing of said pendulum.

2. The device of claim 1 wherein said ball and abutment closures are fabricated of metal.

3. The device of claim 2 wherein said cage member is of circular cylindrical shape.

4. A clock having a simulated pendulum mechanism having a straight vertical shaft, and a sound producing device associated with said pendulum mechanism, said device comprising:

a) a cage member elongated upon a center axis between opposed end extremities, and associated with said pendulum mechanism in a manner disposing said axis orthogonally to said shaft and disposing said end extremities equidistantly from said shaft, b) hard abutment closures disposed at each extremity of said cage member, and c) a ball held within said cage member and adapted to roll into contact with each abutment closure at the apogee of each swing of said pendulum.

5. The clock of claim 4 wherein said sound producing device is positioned in a manner such that it travels in a circular arc with movement of the pendulum mechanism, said center axis disposed as a tangent to said arc, and said arc having a radius of curvature between 1 and 6 inches.

6. The device of claim 3 wherein said abutment closures are spaced apart between ½ and 2 inches.

7. The device of claim 6 wherein said abutment closures are flat and orthogonally disposed to said center axis.

* * * * *